US007096585B2

(12) United States Patent
Bota

(10) Patent No.: US 7,096,585 B2
(45) Date of Patent: Aug. 29, 2006

(54) APPARATUS AND METHOD FOR AUTOMATED PRODUCTION OF ADJUSTABLE DUCT MEMBER

(75) Inventor: Victor Bota, Brooklyn, OH (US)

(73) Assignee: Cleveland Tool & Machine, Inc., Brook Park, OH (US)

( * ) Notice: Subject to any disclaimer, the term of this patent is extended or adjusted under 35 U.S.C. 154(b) by 262 days.

(21) Appl. No.: 10/659,445

(22) Filed: Sep. 10, 2003

(65) Prior Publication Data

US 2005/0028337 A1 Feb. 10, 2005

Related U.S. Application Data

(60) Provisional application No. 60/492,931, filed on Aug. 6, 2003.

(51) Int. Cl.
*B21D 51/16* (2006.01)

(52) U.S. Cl. ..... 29/890.145; 29/2.1; 29/33 T; 29/890.03; 29/890.14; 29/890.144; 29/890.149

(58) Field of Classification Search ..... 29/564, 29/564.1–2, 564.6, 564.7, 564.8, 33 D, 33 K, 29/33 T, 890.03, 890.14, 890.144, 890.145, 29/890.149, 2.1
See application file for complete search history.

(56) References Cited

U.S. PATENT DOCUMENTS

| | | | | |
|---|---|---|---|---|
| 3,010,506 A | | 11/1961 | Bellatorre | |
| 3,724,255 A | * | 4/1973 | Molino | 72/306 |
| 3,815,394 A | | 6/1974 | Walker | |
| 3,861,184 A | | 1/1975 | Knudson | |
| 4,198,842 A | * | 4/1980 | Pawlaczyk | 72/307 |
| 6,105,227 A | | 8/2000 | Bota | |
| 6,363,764 B1 | | 4/2002 | Bota | |
| 6,378,184 B1 | | 4/2002 | Bota | |
| 2004/0158986 A1 | * | 8/2004 | Munoz | 29/890.149 |

OTHER PUBLICATIONS

Iowa Precision, "Adjust-A-Matic Automatic Elbow Machine—Operator's Manual," 23 pages, (Sep. 19, 1994).
Iowa Precision, "Ajust-A-Matic", printed from the Internet, http://www.iowaprecision.com/p6.htm, 1 page, (Mar. 3, 1999).

* cited by examiner

*Primary Examiner*—Monica S. Carter
*Assistant Examiner*—Eric A. Gates
(74) *Attorney, Agent, or Firm*—Hahn Loeser & Parks, LLP; Robert J. Clark

(57) ABSTRACT

An apparatus and method for forming a duct member having a plurality of adjustable sections which are rotatable relative to one another. The apparatus and method causes relative rotation between individual sections during the manufacturing process, to form a completed duct member in an automated process utilizing a rotating head assembly comprising a plurality of engagement members extendable radially outward of the rotating head body in an engagement position and retractable radially inward to a disengagement position. Accordingly, a 90 degree adjustable elbow can be produced in its 90 degree elbow configuration without requiring the machine operator to manually adjust the adjustable sections.

6 Claims, 5 Drawing Sheets

APPARATUS AND METHOD FOR AUTOMATED PRODUCTION OF ADJUSTABLE DUCT MEMBER

TECHNICAL FIELD

This application claims the benefit of U.S. Provisional Patent Ser. No. 60/492,931, filed Aug. 6, 2003, hereby incorporated by reference. The invention is generally directed to an apparatus and method for forming an adjustable duct member, and particularly to automatically rotating certain duct sections relative to other sections to form a finished adjustable duct member without the need for manual adjustment.

BACKGROUND OF THE INVENTION

In general, duct work is commonly used in forced air heating and air conditioning systems for buildings and the like. To facilitate installation of a duct work system, various types of duct members have been developed, including adjustable duct members such as elbow ducts. Elbow ducts typically have a plurality of sections which are independently adjustable relative to one another to form the duct member into a variety of configurations. The adjustability of the elbow allows flexibility in connecting duct systems in a desired manner. Each of the sections of the elbow duct member are coupled to adjacent sections by means of a connective fitting, which allows relative rotation between the sections. In the manufacture of such duct members, the duct is originally manufactured in a straight tubular construction, with the individual sections or gores of the adjustable duct member not being rotated relative to one another. Subsequent to manufacture, and for commercial sale, a worker is required to manually rotate the independent sections or gores of the duct member relative to one another to form the duct into the elbow configuration. With automatic elbow machines capable of producing thousands of elbows per day, such a process is labor intensive, and requires a constant repetitive motion, which can result in repetitive motion injuries such as carpal tunnel syndrome. It would therefore be desirable to provide in conjunction with the automated manufacture of a duct member, the ability to form the duct member into a final configuration for commercial sale, without requiring the foregoing manual operation.

SUMMARY OF THE INVENTION

Based upon the foregoing, the present invention is directed at an apparatus and method for forming a duct member, wherein the duct member has a plurality of adjustable sections which are rotatable relative to one another. In the manufacture of the duct member, the apparatus causes relative rotation between individual sections during the manufacturing process, to form a completed duct member in an automated process. These and other advantages are provided by a rotating head assembly for an automatic adjustable duct machine comprising: a rotating head body; a slide block having a cutting wheel and a beading wheel thereon, wherein the slide block is moveable within the head body to selectively extend one of the cutting wheel and the beading wheel radially outward from the rotating head body; and a plurality of engagement members extendable radially outward of the rotating body in an engagement position and retractable radially inward to a disengagement position. Other objectives and advantages of the invention will become apparent from the following description, taken in conjunction with the drawings.

DETAILED DESCRIPTION OF THE INVENTION

Figure 1:
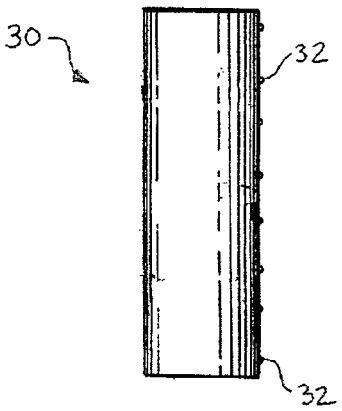
FIG. 1 is a side elevational view of a workpiece for use in the apparatus of the present invention in making an adjustable duct member in accordance with the present invention.
Figure 7:
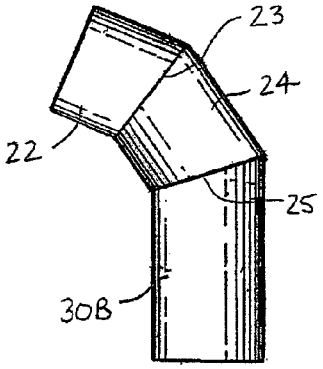
Figure 8:
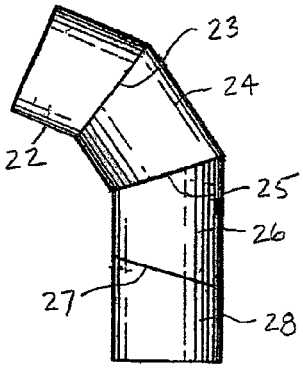
Figure 9:
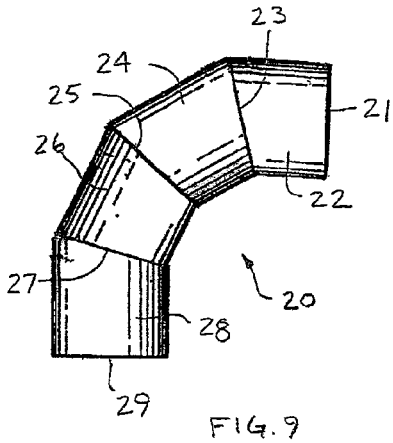
FIG. 9 is a side elevational view of a finished adjustable duct member as removed from the apparatus of the present invention.

Turning now to FIGS. 1–9, the invention is directed at producing an adjustable duct member such as shown in FIG. 9, wherein the adjustable duct member 20, shown herein as a ninety degree adjustable elbow, from a workpiece 30 or blank as shown in FIG. 1, with intermediate steps shown in FIGS. 2–8, discussed in detail below. Referring to FIG. 9, the final automatically produced duct member 20 comprises a plurality of sections or gores 22, 24, 26, and 28. The gores 22, 24, 26, and 28 are rotatably connected to their adjacent members by adjustable seams 23, 25, and 27 also referred to as coupling beads. Seams 23, 25, and 27 are formed at a 15 degree angle such that rotation of adjacent gores can result in an angle between zero (as initially formed) and thirty degrees (when rotated one hundred eighty degrees). As shown, the adjacent gores 22, 24, 26, and 28 are at an angle of thirty degrees with their adjacent members to form a ninety degree adjustable elbow 20. The duct member 20 further comprises an inlet opening 21 and an outlet opening 29, being adapted to be coupled between other members in a duct system associated with the air handling system.

Figure 10:
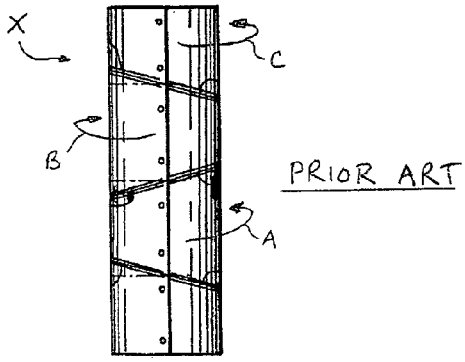
FIG. 10 is a side elevational view of a prior art finished adjustable elbow as removed from a prior art automatic elbow machine.

As shown in FIG. 1, the duct member 20 maybe produced from a flat blank of material which is rolled such that opposed seams of the blank slightly overlap and are coupled to one another to form the tubular blank workpiece configuration 30. Coupling at the overlapping seams may be provided in any suitable manner, such as by riveting 32 or the like. As an example, the tubular configuration 30 of the formed blank of material may provide a starting work piece 30 which may then be operated on by the apparatus and methods of the invention. The work piece 30 is designed to have a predetermined configuration and dimensional characteristics for use in the apparatus and methods of the invention, but any suitable particular dimensional characteristics of the work piece can be accommodated. The apparatus and methods of the invention will take the work piece as shown in FIG. 1 and produce adjustable seams or beads 23, 25, and 27 in the work piece as depicted in FIGS. 2–8 to form the duct member 20 in the final preferred form as shown in FIG. 9. In contrast, existing automatic elbow machines will produce a final article X as shown in FIG. 10 and requiring manual rotation A, B, C of each gore by an operator to form a 90 degree elbow.

Figure 11:
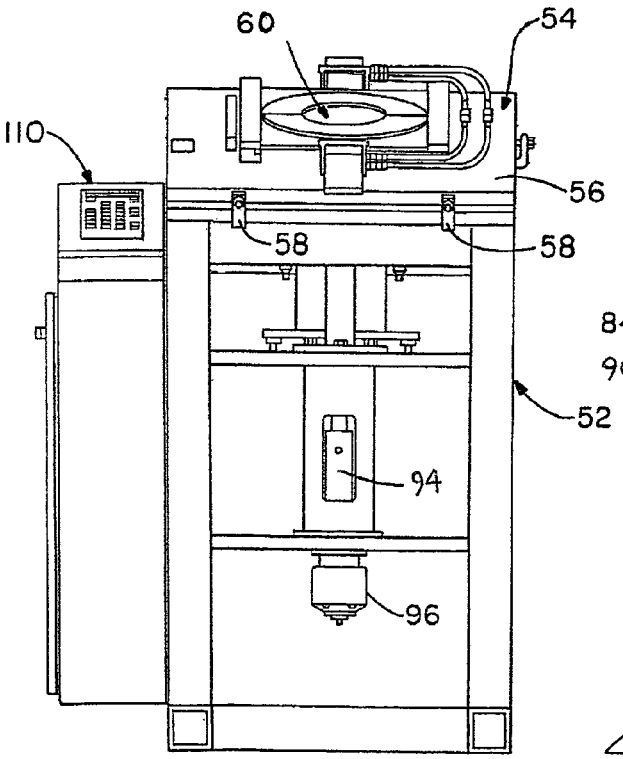
FIG. 11 is a plan view of an apparatus for forming an adjustable duct member in accordance with the present invention.
Figure 12:
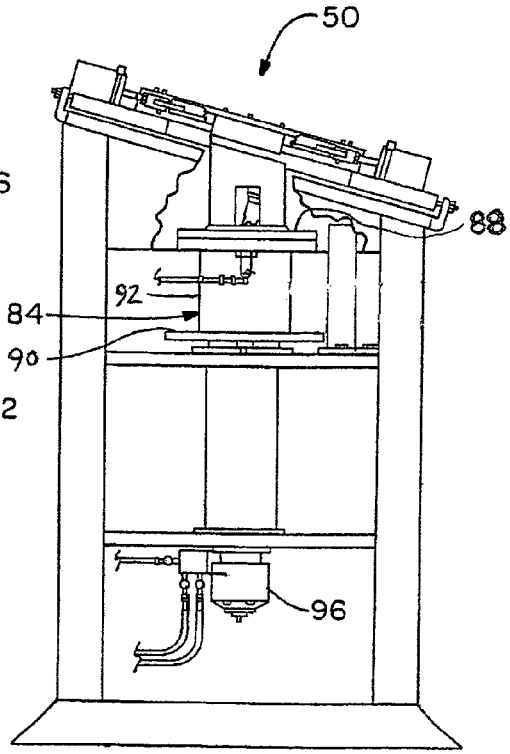
FIG. 12 is a side view of the apparatus as shown in FIG. 11.
Figure 13:
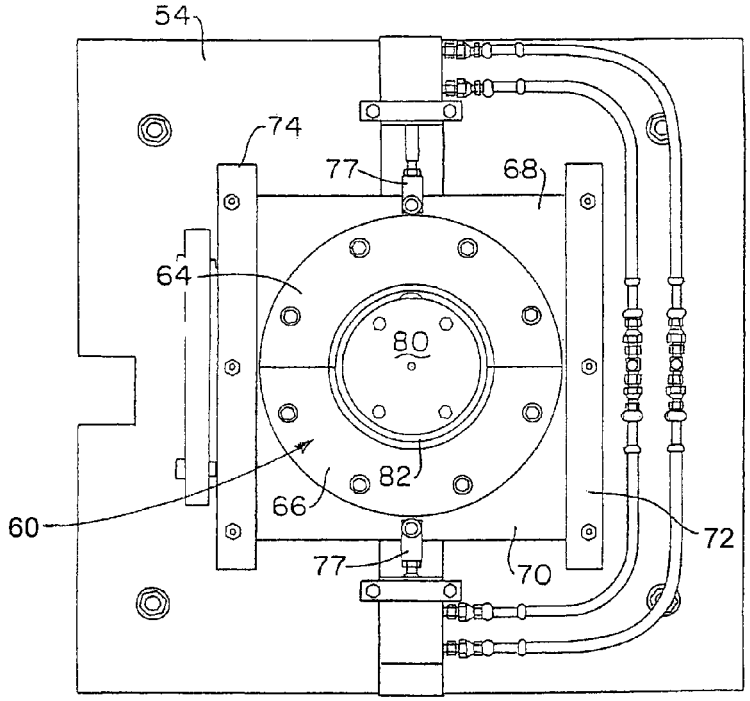
FIG. 13 is a top view of the apparatus as shown in FIG. 11.

Turning now to FIGS. 11–13, an embodiment of the apparatus according to the present invention is shown in more detail. The apparatus generally designated 50 includes a housing or frame construction 52 which supports various components of the apparatus. Housing or frame 52 includes an upper surface 54 which is preferably defined by a floating support plate 56 which is adjustably mounted to the frame 52. The upper support plate 56 is angled at a predetermined angle relative to horizontal or ultimately to the plane of one of the inlet or outlet openings 21, 29 associated with the work piece 30, which is supported on a base plate provided as a part of an operating nest arrangement to be more fully described hereafter. Providing plate 56 with some adjustability allows an operator to adjust this predetermined angle to produce a predetermined component as desired. The plate 56 may be held in position by a plurality of support fasteners 58 or other suitable devices. The upper surface 54 of the apparatus 50 may include a work station or nest generally designated 60 which is formed as a recess adapted to accept the work piece 30 discussed in previous figures to perform the operations for cutting and forming the adjustable seams between gores of the work piece.

Figure 19:
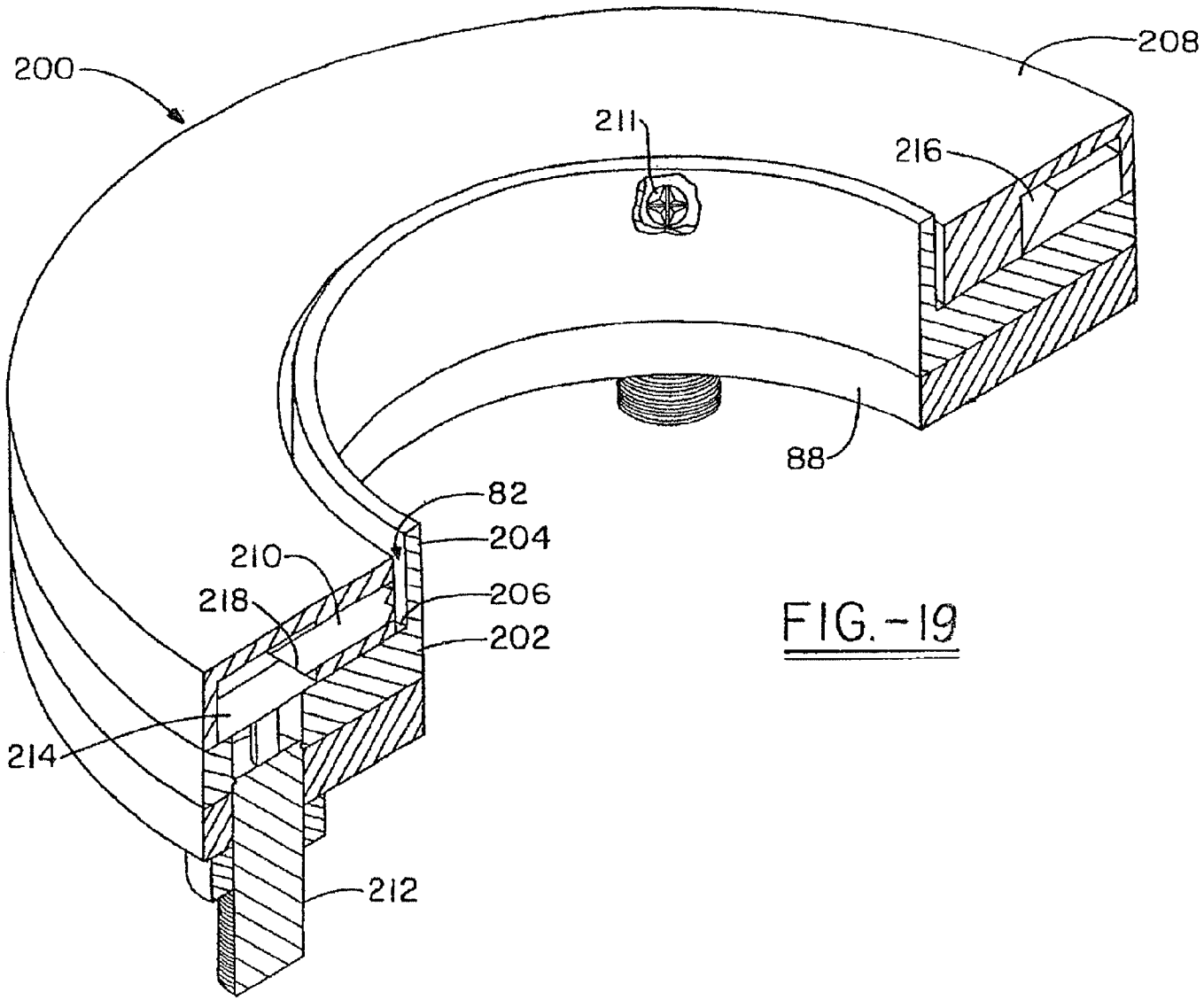
FIG. 19 is a perspective view of the clamp assembly associated with the base plate as shown in FIG. 12.

The nest 60 can include a die supported on the upper surface, which in the first embodiment may be comprised of first and second semicircular members 64 and 66 which are positioned on opposed sides of the nest 60. The die members 64 and 66 are positioned immediately adjacent the nest 60 in operation, but may be moved into a non-operational position away from the nest 60 when desired in a manufacturing cycle. Therefore, each of the die members 64 and 66 may be supported in association with a slidable plate 68 and 70 which is supported in sliding engagement with support blocks 72 and 74 in a channel or slot 76. The support block 74 may be adjusted relative to the plates 68 and 70 for smooth slidable operation of the plates within slot 76. Each of the plates 68 and 70 may be moveable toward and away from the nest 60 by means of a hydraulic ram 77 or other suitable mechanism. Within the nest 60, a cutting and forming system 80 is provided in the recessed portion of the nest 60. Between the die members 64 and 66 and the cutting and forming system 80, a circular channel 82 is formed by the recess of the nest 60, the channel 82 being dimensioned to accept the work piece 30 (shown in FIG. 1), with the work piece 30 extending into the channel 82 to a predetermined depth. Associated with the nest 60 is a base plate 88 at the bottom of channel 82 on which the work piece is supported within the nest 60 at the predetermined position. The base plate 88, also referred to as the tube holding plate, includes a means (not shown) for clamping the work piece 30 to the base plate 88 to help prevent the work piece from rotating during cutting and forming operations and to couple the work piece 30 to the base plate 88 when the base plate 88 is rotated as discussed in detail below. Referring to FIG. 19, the base plate 88 has a clamp assembly 200 mounted thereto comprising a base ring 202 having an upwardly turned tubular extension 204 along and interior diameter thereof. The interior diameter of extension 204 provides clearance for support block 142 which will be discussed in detail below. The outer diameter of extension 204 is of a predetermined size such that either the inlet end 21 or outlet end 29 of work piece 30 fits over the extension 204 and is positioned a predetermined depth by contact with the top surface 206 of base ring 202. Clamp assembly 200 also comprises a clamp ring 208 mounted and affixed to the top surface 206 of base ring 202. Clamp ring 208 has an interior diameter larger than the outer diameter of extension 204 such that the channel 82 is formed allowing clearance for the insertion of one of either the inlet end 21 or outlet end 29 of work piece 30. The clamp ring 208 comprises one or more clamp members 210 which are hydraulically or electrically actuated by one or more corresponding pistons 212. The clamp members 210 are generally oriented perpendicular to extension 204 and parallel to the top surface 206 of base ring 202. The clamp members 210 are generally shown herein as cylindrical members having a gripping irregular surface 211 on one end thereof. The piston 212 is connected to a piston ring 214 which moves upward and downward within clamp ring 208. The piston ring 214 has an angled surface 216 along and interior diameter surface thereof. The angled surface 216 engages an angled surface 218 on clamp member 210, on an end opposite the gripping irregular surface 211, such that upward movement of piston ring 214 forces the clamp member 210 inward against the wall of work piece 30, and against extension 204. The work piece 30 is securely held in place by the gripping irregular surface 211 as cutting and forming operations are perform thereon as will be discussed in detail below. The gripping pressure can be increased by adding additional pistons/gripping members. Although a specific clamping means is shown and described, the invention is not limited to a particular clamping system. The clamping means may be of any known clamping apparatus, however, it is preferred that the clamping means disclosed in U.S. Pat. No. 6,378,184, hereby incorporated by reference, are utilized. Referring again to FIGS. 11–13, the base plate 88 is formed in association with a moveable platen 84 which is operated on by a pair of hydraulic rams or other suitable mechanism to selectively move platen 84 upwardly or downwardly with respect to the housing and other components of the apparatus 50. The moveable platen 84 preferably carries at its upper end the base plate 88, with a drive plate 90 at the bottom end thereof. The central portion 92 of platen 84 is a cylindrical portion extending between plates 88 and 90. The plates 88 and 90 each have apertures coinciding with the cylindrical portion 92 to define a hollow interior through which a drive shaft arrangement 94 is positioned. The drive shaft system 94 is coupled to be driven by a hydraulic motor 96 supported in association with housing 52. The platen assembly 84 is moveable about the drive shaft assembly 94 upwardly and downwardly to selectively position a work piece 30 relative to the die members 64 and 66 and the cutting and forming system 80.

The apparatus 50 also preferably includes a control system generally designated 110, which may be any suitable system such as a microprocessor or PLC based system, to selectively perform the various operations and steps to produce the duct member 20 according to the methods of the invention. Preferably, control system 110 can be designed to automatically perform various operations in a manufacturing sequence to produce a particular type of duct member 20. Each different type of duct member will effectively have a process sequence recipe that can be simply recalled using the control system 110, with subsequent automated performance of each step in the manufacture of the duct member 20. In this way, an unskilled operator can simply recall a particular recipe for the type of duct member to be produced, alleviating the necessity for a skilled operator and simplifying the manufacturing process.

Figure 14:
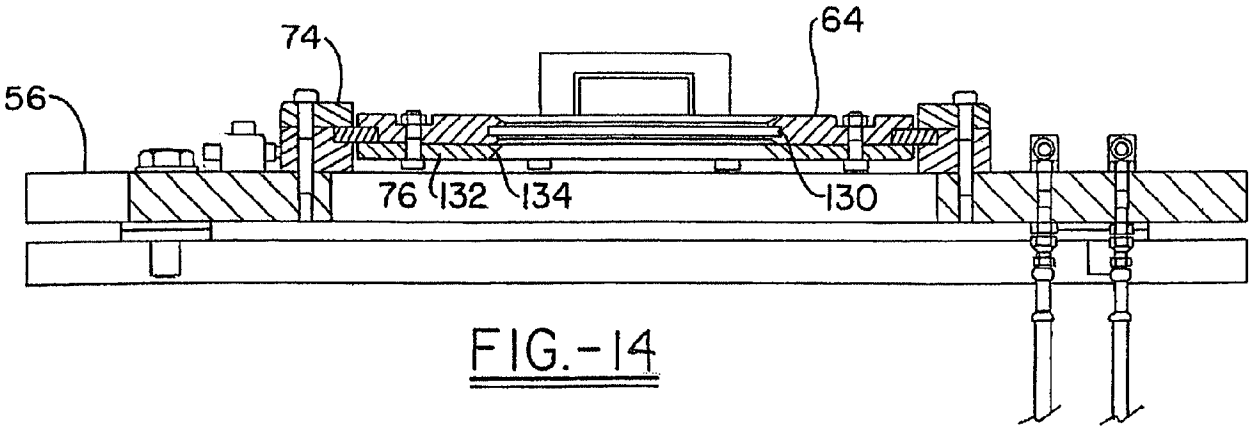
FIG. 14 shows a partial sectional view of the upper plate and die assembly of the apparatus as shown in FIG. 11.

Turning now to FIG. 14, the top plate assembly and associated die members and are shown in more detail. The die members 64 and 66 as previously described are designed to cooperate with one another to form when positioned adjacent the work piece a stationary form into which material of the work piece is pushed by the cutting and forming system 80. Preferably the die members 64 and 66 are formed to include a recess, which will cooperate with a portion of the forming system 80 to generate an outwardly directed bead in the work piece of substantial depth. It is pointed out that, die members 64 and 66 also perform a clamping function in addition to the forming function of the die. This enables both cut sections to be properly secured during and after the cutting and forming operation. Below the forming section of the die, a separate plate 132 may be provided with an outwardly extending knife edge 134 which is designed in cooperation with the cutting and forming assembly to cut the work piece at the desired position. The cutting plate, or ring 132, is fixably attached to the die members 64 and 66. Providing the knife as a separate member 132 facilitates maintenance of the apparatus, as it is possible for the knife or knife edge to become damaged, simplifying replacement of the plate 132 without impact on the forming section of the die formed by die member 64 and 66. The particular shape of the forming portion or knife portion of the die may be modified to produce a desired coupling bead configuration other than that shown in the preferred embodiment.

Figure 15:
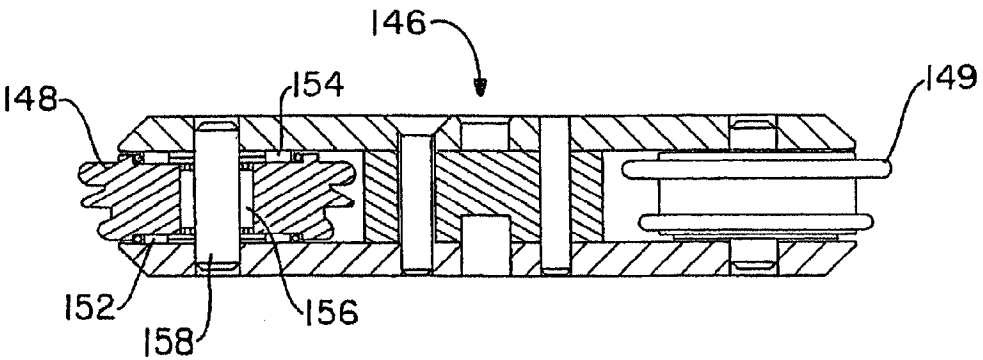
FIG. 15 shows a partial sectional view of the roller assembly of the cutting and forming assembly as shown in FIG. 16.
Figure 16:
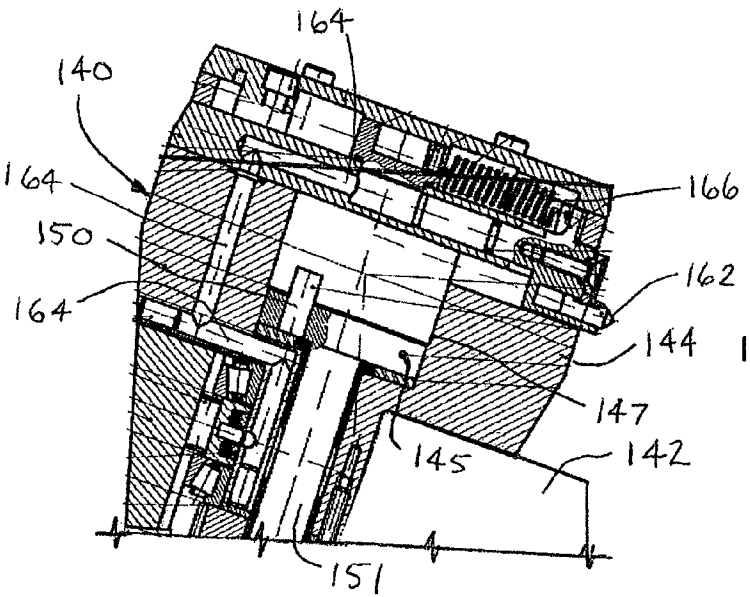
FIG. 16 shows a partial sectional view of the cutting and forming head assembly including the interior tube gripping means of the apparatus as shown in FIG. 11.

FIGS. 15 and 16 refer to a first embodiment of the cutting and forming assembly 80 of the invention. In FIG. 11, the cutting and forming assembly may comprise a head portion 140 including a supporting block 142 carrying a rotating working head 144 shown in section. The drive shaft 94 driven by motor 96 is positioned to extend through the support block 142 and is coupled to the working head 144 for selective rotation thereof. The working head 144 includes a moveable slide block 146 mounted within a slot 147, having a cutting wheel 148 at one end thereof and a beading wheel 149 on the other end. The slide block 146 is moved back and forth to provide cutting and beading steps successively, with each of the wheels 148 and 149 being successively exposed to perform these operations as the head 144 rotates. The back and forth motion of the slide block 146 within slot 147 is created by an eccentric drive shaft 151 mounted in the center of the working head 144. The eccentric shaft 151 includes an eccentric drive head 145. An off-center pin 150 associated with the eccentric drive head 145 is engaged in a slot in the bottom of the slide block 146 which moves the slide block 146 within slot 147 so as to selectively expose one of the wheels 148 or 149 as the head 144 rotates. To cut and preform the workpiece, the slide block 144 is initially centered within slot 147, and the cutting wheel 148 is then moved out into engagement with the interior of the work piece, and cooperates with the knife edge on the stationary die member as previously described to cut the work piece. To couple the cut portions, the slide block 146 moves to expose the beading wheel 149 after the cut pieces of the tube are positioned in overlapping relationship. In cooperation with the stationary die member, the bead coupling is formed.

Figure 17:
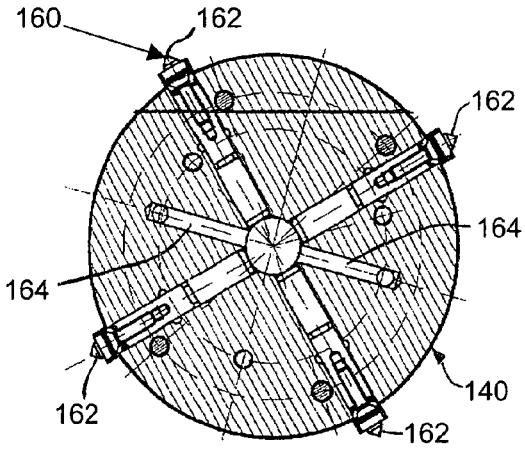
FIG. 17 shows a sectional view of the cutting and forming head assembly showing the hydraulic system for actuating the interior tube gripping means.
Figure 18:
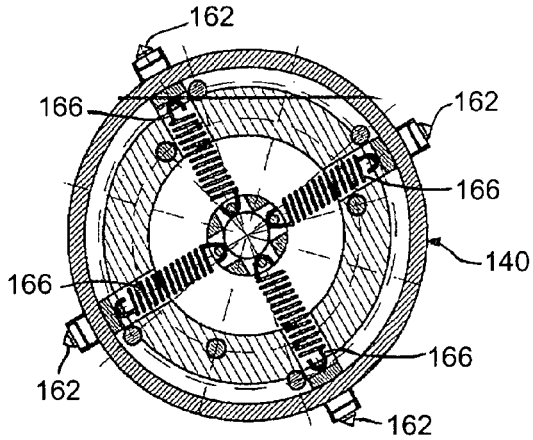
FIG. 18 shows a sectional view of the cutting and forming head assembly showing the biasing system for retracting the interior tube gripping means.

The head portion 140 further comprises a means 160 for engaging the interior of the workpiece such that the cut portion of the workpiece is able to be rotated one hundred eighty degrees with respect to the remaining workpiece as described in detail below. As shown, means 160 comprises a plurality of fingers 162 extendable radially outward from the head 140. The fingers 162 are shown to be activated by hydraulic pressure through internal hydraulic line 164. If necessary, the gripping pressure can be increased by adding additional fingers/gripping members 162. When the pressure is released, a biaser 166 shown herein as a spring, forces each finger 162 radially inward to a position disengaged from the interior of the workpiece. FIGS. 17 and 18 show cross-sections of the head highlighting the hydraulic passages which activate the fingers 162 and the biaser 166 connections which retract the fingers 162, respectively.

Figure 2:
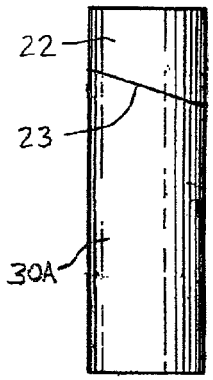
FIGS. 2–8 are side elevational views of different intermediate stages of making an adjustable duct member in accordance with the present invention.
Figure 3:
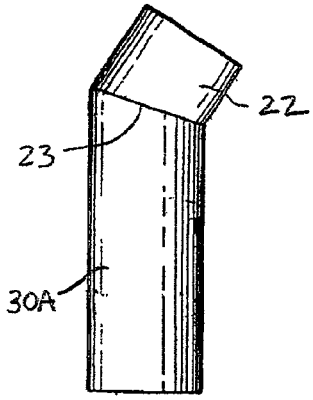
Figure 4:
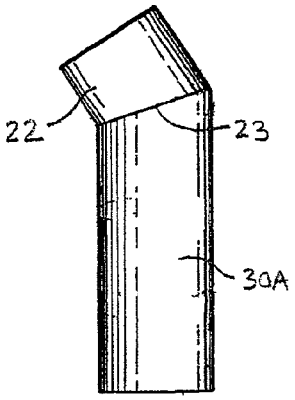

The method of the present invention is now discussed in detail with reference to FIGS. 1–9 showing the stages of production of the workpiece and the apparatus 50 as shown in FIGS. 11–17. The starting work piece 30 (FIG. 1) is placed into the channel 82 of the nest 60 of apparatus 50. The bottom of work piece 30 is secured by the clamping means of the tube holding plate to prevent unintentional rotation of the work piece 30. The cutting and forming assembly 80 performs the first cut and preform to the work piece 30 as previously described in association with the dies 64, 66, forming a first gore 22 or upper tube and the remaining work piece 30A or lower tube (FIG. 2). (At this point the dies 64, 66 may need to be slightly retracted). The tube holding plate will lift the lower tube 30A slightly into upper tube 22. The fingers 162 on the head are hydraulically actuated to engage the inside of the upper tube 22 to provide a means of holding the upper tube 22. The head then rotates the upper tube 22 one hundred eighty degrees (it is also contemplated that the head 140 may remain stationary and that the tube holding plate may rotate the lower tube 30A by one hundred eighty degrees) and then the fingers 162 are disengaged as previously described. The tube holding plate then elevates the lower tube 30A into the upper tube 22 a sufficient amount to form a coupling bead. (At this point the dies are again extended if previously retracted) The cutting and forming assembly 80 then forms the coupling bead 23. At this point (FIG. 3), the longitudinal axis of the first gore 22 is approximately thirty degrees transverse to the remaining work piece 30A. The tube holding plate then rotates the work piece 30 one hundred eighty degrees and elevates the work piece 30 to a second cutting position (FIG. 4).

Figure 5:
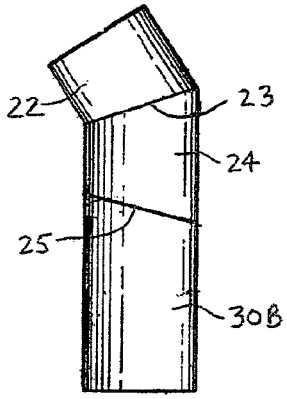
Figure 6:
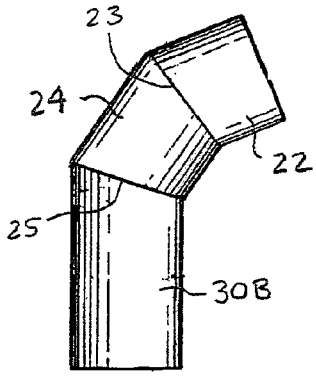

The cutting and forming assembly 80 performs the second cut and preform to the work piece 30, forming a second gore 24 below the first gore 22, and above the remaining work piece 30B or lower tube (FIG. 5). The tube holding plate will lift the lower tube 30B slightly into second gore 24. The fingers 162 on the head 140 are hydraulically actuated to engage the inside of the second gore 24 to provide a means of holding the second gore 24. The head 140 then rotates the second gore 24 (and the attached upper gore 22) one hundred eighty degrees and the fingers 162 are disengaged. The tube holding plate then elevates the lower tube 30B into the second gore 24 a sufficient amount to form an adjustable seam. The cutting and forming assembly 80 then forms the adjustable seam 25. At this point (FIG. 6), the longitudinal axis of the second gore 24 is approximately thirty degrees transverse to the longitudinal axis of the remaining tube 30 B and approximately thirty degrees transverse to the longitudinal axis of the first gore 22. The tube holding plate then rotates the work piece 30 by one hundred eighty degrees to a third cutting position (FIG. 7).

The cutting and forming assembly 80 performs the third cut and preform to the work piece 30 forming a third gore 26 and a fourth gore 28 or lower tube (FIG. 8). The tube holding plate will lift the fourth gore 28 slightly into the third gore 26. The fingers 162 on the head 140 are hydraulically actuated to engage the inside of the third gore 26 to provide a means of holding the third gore 26. The head 140 then rotates the third gore 26 (and the attached first and second gores 22, 24) one hundred eighty degrees. The tube holding plate then elevates the fourth gore 28 into the third gore 26 a sufficient amount to form an adjustable seam. The cutting and forming assembly 80 then forms the adjustable seam 27. At this point (FIG. 9), the longitudinal axis of the third gore 26 is approximately thirty degrees transverse to the longitudinal axis of the fourth gore 28 and approximately thirty degrees transverse to the longitudinal axis of the second gore 24 such that the work piece 30 has now been converted into a ninety degree elbow 20 without requiring any manual rotation of the gores 22, 24, 26, 28. The finished duct member 20 is then removed from the apparatus 50 and the process is repeated.

Although the present invention has been shown to produce a duct member in the form of a standard, four-gore, ninety degree elbow, any duct member having adjustable gores formed at any angle is contemplated. Embodiments of this invention can be directly applied in other forming machines such as those described in U.S. Pat. No. 6,378,184 and U.S. Pat. No. 6,105,227, hereby incorporated by reference. While the above description has been presented with specific relation to a particular embodiment of the invention and methods of producing a specific adjustable duct member, it is to be understood that the claimed invention is not to be limited as such and that certain changes may be made without departing from the scope of the invention with the above description intended to be interpreted as illustrative and not limiting.

What is claimed is:

1. A method for forming a duct member for use in an air handling system comprising the steps of:

a) providing a tubular work piece having a general constant diameter along the length of the tube;

b) inserting the tubular work piece into an automatic adjustable duct machine and performing the following steps c) through i) without removing the tubular work piece from the automatic adjustable duct machine;

c) clamping the bottom of the work piece d) cutting and preforming the tubular work piece into a first work piece portion and a second work piece along a plane at an angle to a radial plane perpendicular to the longitudinal axis of the work piece;

e) rotating the first work piece portion 180 degrees relative to the second work piece portion such that the first work piece portion is angled to the second work piece portion by an angle generally equivalent to twice the angle of the cut;

f) adjustably connecting the first work piece portion to the second work piece portion while the first work piece portion is angled to the second work piece portion by an angle generally equivalent to twice the angle of the cut;

g) rotating the reconnected work piece 180 degrees;

h) moving the work piece longitudinally to a second position;

i) repeating steps d–f j) releasing the clamped bottom of the work piece such that the work piece can be removed from the automatic adjustable duct machine.

2. The method of claim 1, wherein the angle is 22.5 degrees.

3. The method of claim 2 flirter comprising the step of repeating steps d–h prior to step i.

4. The method of claim 1, wherein the angle is 15 degrees.

5. The method of claim 2, wherein the released work piece is formed as a 90 degree adjustable duct member.

6. The method of claim 2, wherein the released work piece is formed as 90 degree adjustable elbow.

* * * * *